US010938103B2

(12) United States Patent
Mast et al.

(10) Patent No.: US 10,938,103 B2
(45) Date of Patent: Mar. 2, 2021

(54) ANTENNA WITH SINGLE MOTOR POSITIONING AND RELATED METHODS

(71) Applicant: EAGLE TECHNOLOGY, LLC, Melbourne, FL (US)

(72) Inventors: Alan W. Mast, Melbourne Beach, FL (US); Gregory M. Jandzio, Melbourne, FL (US); Charles F. Dull, Palm Bay, FL (US); Kristopher M. Peebles, Palm Bay, FL (US)

(73) Assignee: EAGLE TECHNOLOGY, LLC, Melbourne, FL (US)

( * ) Notice: Subject to any disclaimer, the term of this patent is extended or adjusted under 35 U.S.C. 154(b) by 12 days.

(21) Appl. No.: 15/986,108

(22) Filed: May 22, 2018

(65) Prior Publication Data

US 2019/0363437 A1 Nov. 28, 2019

(51) Int. Cl.

*H01Q 3/14* (2006.01)
*H01Q 1/12* (2006.01)
*H01Q 13/02* (2006.01)

(52) U.S. Cl.

CPC ..... *H01Q 3/14* (2013.01); *H01Q 1/1257* (2013.01); *H01Q 13/02* (2013.01)

(58) Field of Classification Search

CPC ..... H01Q 3/14; H01Q 1/1257; H01Q 13/02; H01Q 1/12; H01Q 1/20; H01Q 3/10; H01Q 3/08; H01Q 1/1207; H01Q 3/1207

See application file for complete search history.

(56) References Cited

U.S. PATENT DOCUMENTS

| | | | | |
|---|---|---|---|---|
| 2,457,562 A | | 12/1948 | Karleen | |
| 2,540,696 A | | 2/1951 | Smith, Jr. | |
| 3,589,208 A | | 6/1971 | Brero | |
| 3,987,452 A | | 10/1976 | Godet | |
| 4,158,845 A | * | 6/1979 | Pinson | H01Q 3/10 244/3.16 |
| 4,312,002 A | | 1/1982 | Stewart | |
| 4,345,256 A | * | 8/1982 | Rainwater | H01Q 3/08 343/754 |
| 4,521,782 A | | 6/1985 | Pinson | |

(Continued)

FOREIGN PATENT DOCUMENTS

WO 2002058189 7/2002

OTHER PUBLICATIONS

Honeywell/Aerospace, "Space to Ground Subsystem (SGS) Gimbal Assembly," retrieved from the internet Mar. 20, 2018 https://aerospace.honeywell.com/en/products/space/space-to-ground-subsystem-sgs-gimbal-assembly, pp. 1-5.

*Primary Examiner* — Dimary S Lopez Cruz
*Assistant Examiner* — Michael M Bouizza
(74) *Attorney, Agent, or Firm* — Allen, Dyer, Doppelt + Gilchrist, P.A.

(57) ABSTRACT

An antenna may include a base, a gimbal mount coupled to the base, and a first guide body coupled to the base and having a first guide slot. The antenna may include a second guide body rotatably coupled with respect to the base and having a second guide slot defining a steerable intersection position with respect to the first guide slot. The antenna may also have an antenna member coupled to the gimbal mount and extending through the steerable intersection position, and an actuator configured to selectively rotate the second guide body to steer the antenna member.

20 Claims, 7 Drawing Sheets

(56) References Cited

U.S. PATENT DOCUMENTS

| | | | | |
|---|---|---|---|---|
| 4,577,825 | A * | 3/1986 | Pinson | H01Q 3/08 248/183.2 |
| 4,866,456 | A | 9/1989 | Ebey | |
| 5,148,177 | A | 9/1992 | Nagamune et al. | |
| 5,214,361 | A | 5/1993 | Labruyere | |
| 5,389,940 | A | 2/1995 | Sutherland | |
| 5,654,723 | A | 8/1997 | Craven et al. | |
| 5,796,370 | A | 8/1998 | Courtonne et al. | |
| 5,835,057 | A | 11/1998 | van Heyningen | |
| 5,952,962 | A | 9/1999 | Dybdal | |
| 6,243,051 | B1 | 6/2001 | Vanstrum et al. | |
| 6,987,489 | B2 | 1/2006 | Melconian et al. | |
| 7,586,462 | B1 | 9/2009 | Tetorka | |
| 2004/0108963 | A1 * | 6/2004 | Clymer | H01Q 13/02 343/837 |
| 2004/0125041 | A1 | 7/2004 | Smith | |
| 2008/0309569 | A1 | 12/2008 | Berejik | |
| 2013/0120202 | A1 | 5/2013 | Lever et al. | |
| 2016/0197394 | A1 | 7/2016 | Harvey et al. | |
| 2016/0352022 | A1 | 12/2016 | Thomson et al. | |
| 2017/0025751 | A1 | 1/2017 | White et al. | |
| 2017/0194704 | A1 | 7/2017 | Chawgo et al. | |

* cited by examiner

ANTENNA WITH SINGLE MOTOR POSITIONING AND RELATED METHODS

TECHNICAL FIELD

The present disclosure relates to the field of radio frequency antennas, and, more particularly, to motor positioned radio frequency antennas and related methods.

BACKGROUND

Wireless communications devices are an integral part of society and permeate daily life. The typical wireless communications device includes an antenna, and a transceiver coupled to the antenna. The transceiver and the antenna cooperate to transmit and receive communications signals.

In some applications, the antenna is directional. In other words, the angle of the aim of the antenna affects the quality of the received signal, depending on the received signal's angle of incidence. For example, the common pay television home satellite dish is precisely aligned and aimed to ensure the signal is received from the geosynchronous orbit satellite. In the home satellite application, the signal source is stationary and the satellite dish is manually aimed once.

In other applications, the signal source may not be stationary, and antenna aiming may need to be performed frequently. In these applications, the antenna may have motorized steering, i.e. an antenna positioning mechanism. In common approaches, since the antenna must be aimed in at least two axes, the antenna system would include multiple motors for driving the steering, for example, the Space to Ground Subsystem (SGS) Gimbals satellite aiming device from Honeywell International Inc. of Morris Plains, N.J., United States.

SUMMARY

Generally, an antenna may include a base, a gimbal mount coupled to the base, a first guide body coupled to the base and having a first guide slot therein, and a second guide body rotatably coupled with respect to the base and having a second guide slot therein defining a steerable intersection position with respect to the first guide slot. The antenna may include an antenna member coupled to the gimbal mount and extending through the steerable intersection position, and an actuator configured to selectively rotate the second guide body to steer the antenna member.

More specifically, the first guide body may have a dome shape. The first guide slot may have one of a spiral shape and a C-shape. The second guide body may have an elongate curved shape. The second guide slot may have an elongate shape.

In some embodiments, the antenna further comprises a drive gear coupled between the second guide body and the actuator. The second guide body may have a geared periphery to be driven by the drive gear. For example, the antenna member may comprise a horn antenna. The actuator may comprise a single electrical motor.

Another aspect is directed to a method for making an antenna. The method may include coupling a gimbal mount to a base, coupling a first guide body to the base, the first guide body having a first guide slot therein, and rotatably coupling a second guide body with respect to the base. The second guide body may have a second guide slot therein defining a steerable intersection position with respect to the first guide slot. The method may comprise coupling an antenna member to the gimbal mount and extending through the steerable intersection position, and coupling an actuator to selectively rotate the second guide body to steer the antenna member.

DETAILED DESCRIPTION

Figure 1:
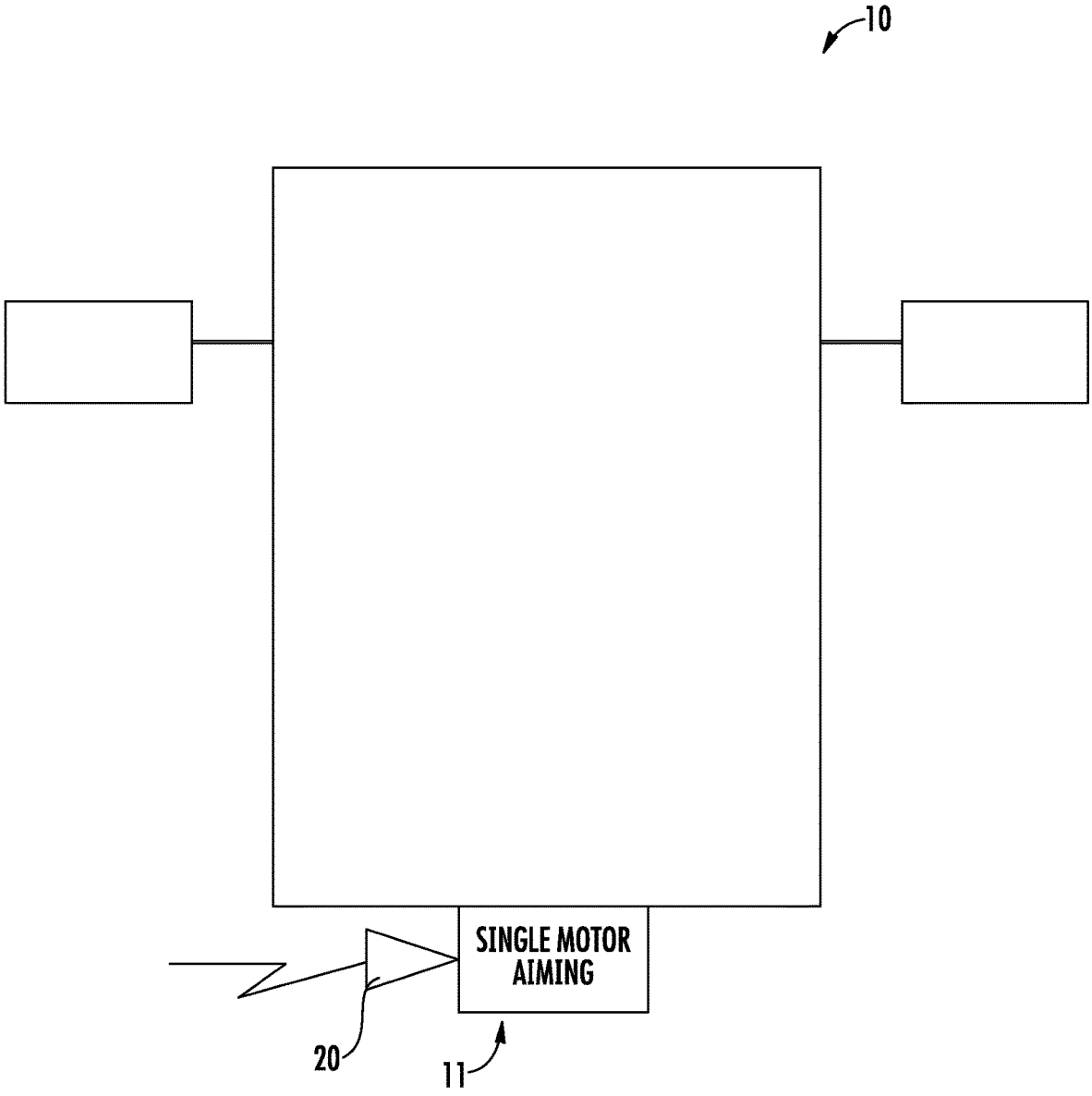
FIG. 1 is a schematic diagram of a communication system including an antenna, according to the present disclosure.
Figure 2:
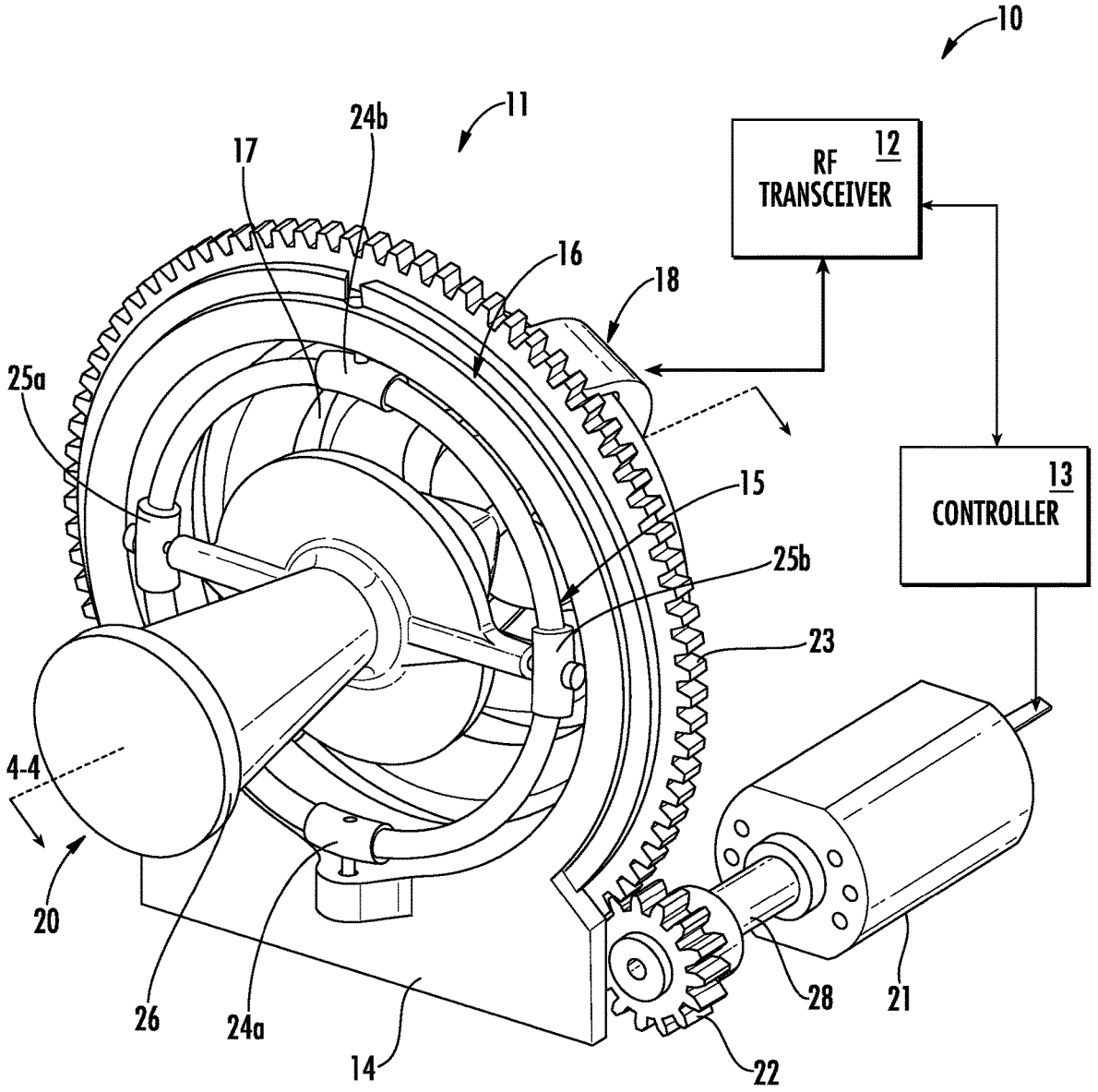
FIG. 2 is a schematic perspective view of the communication system of FIG. 1.
Figure 3:
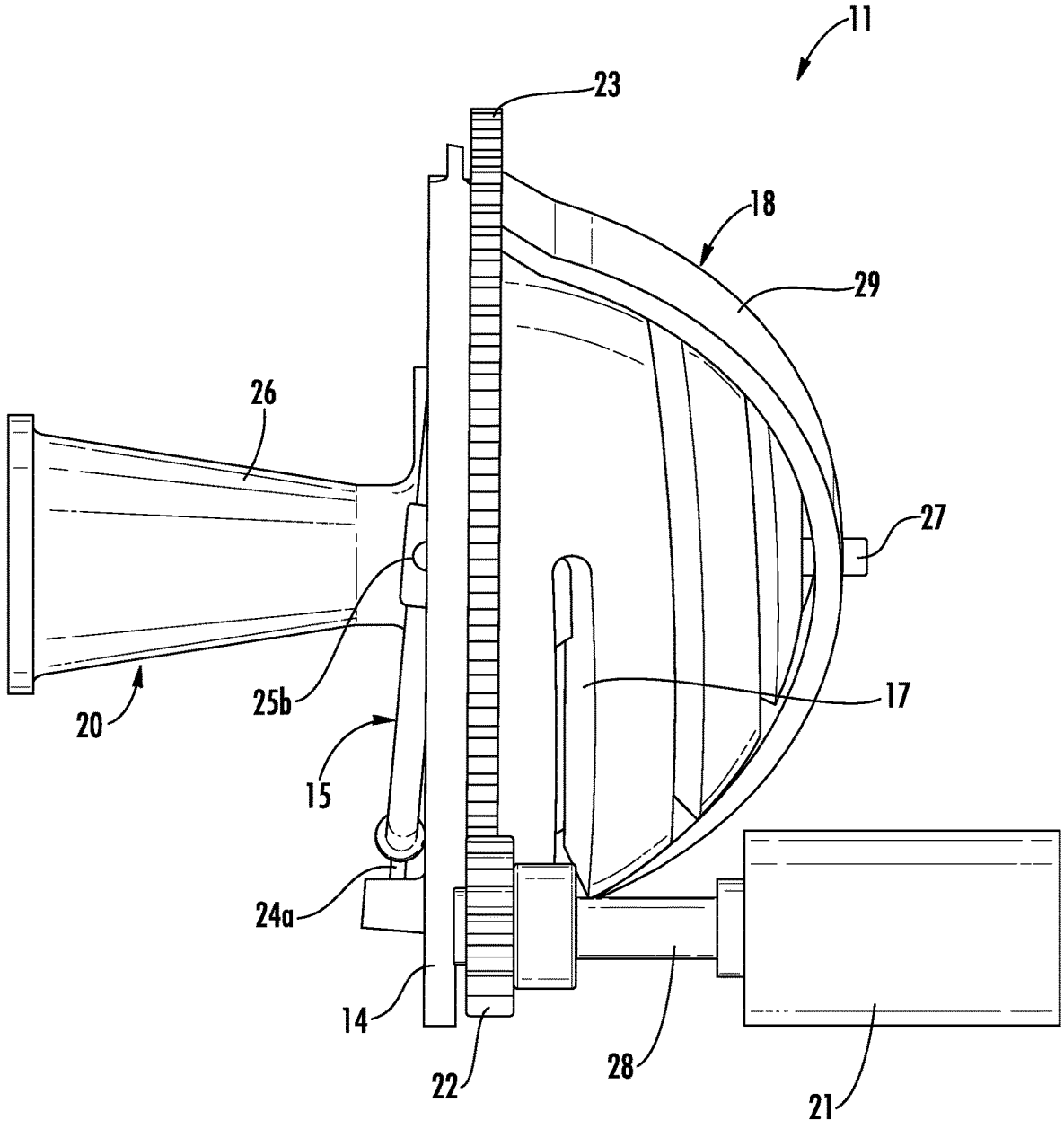
FIG. 3 is a schematic side elevational view of the antenna from the communication system of FIG. 1.
Figure 4:
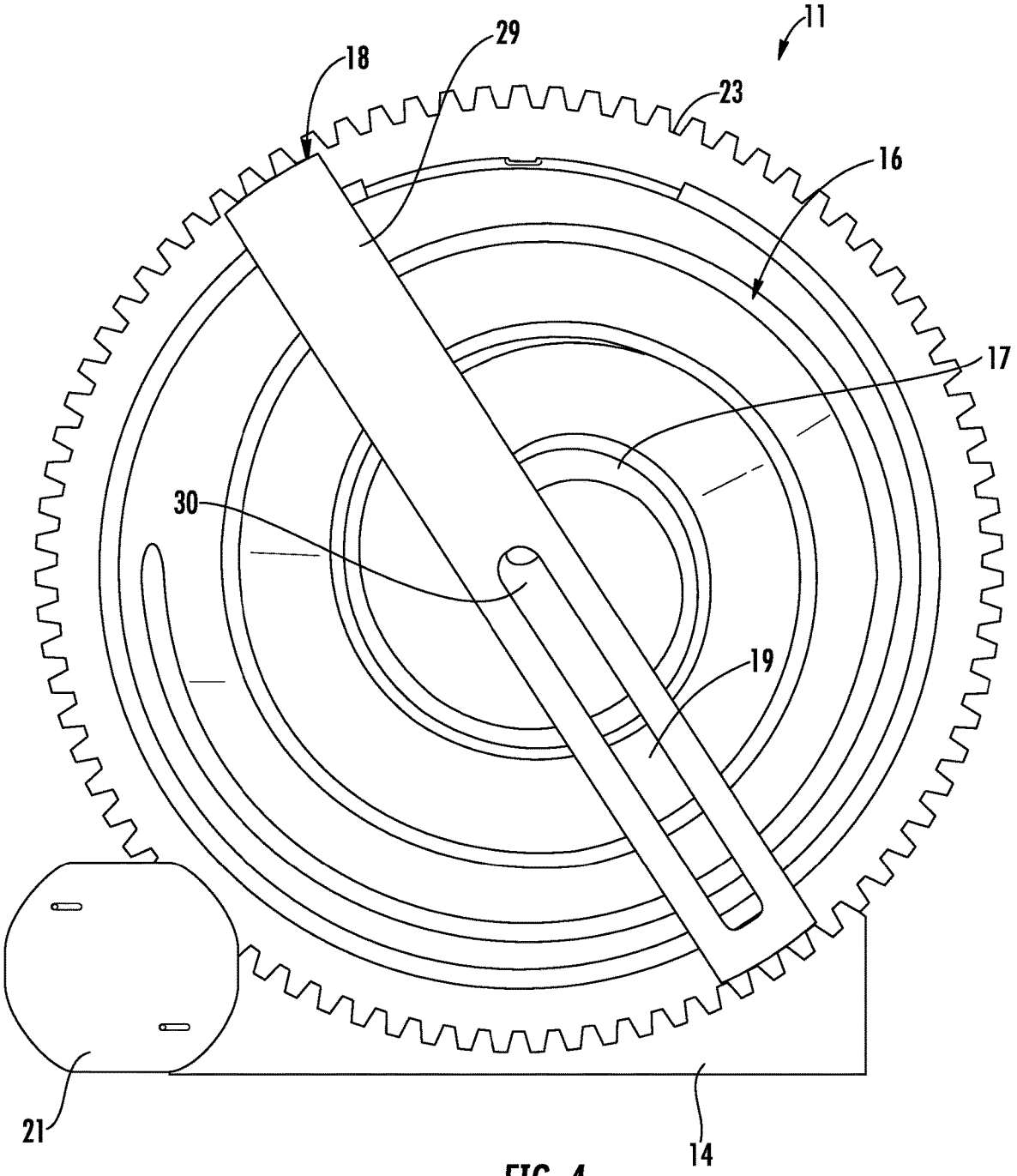
FIG. 4 is a schematic rear elevational view of the antenna from the communication system of FIG. 1.
Figure 5:
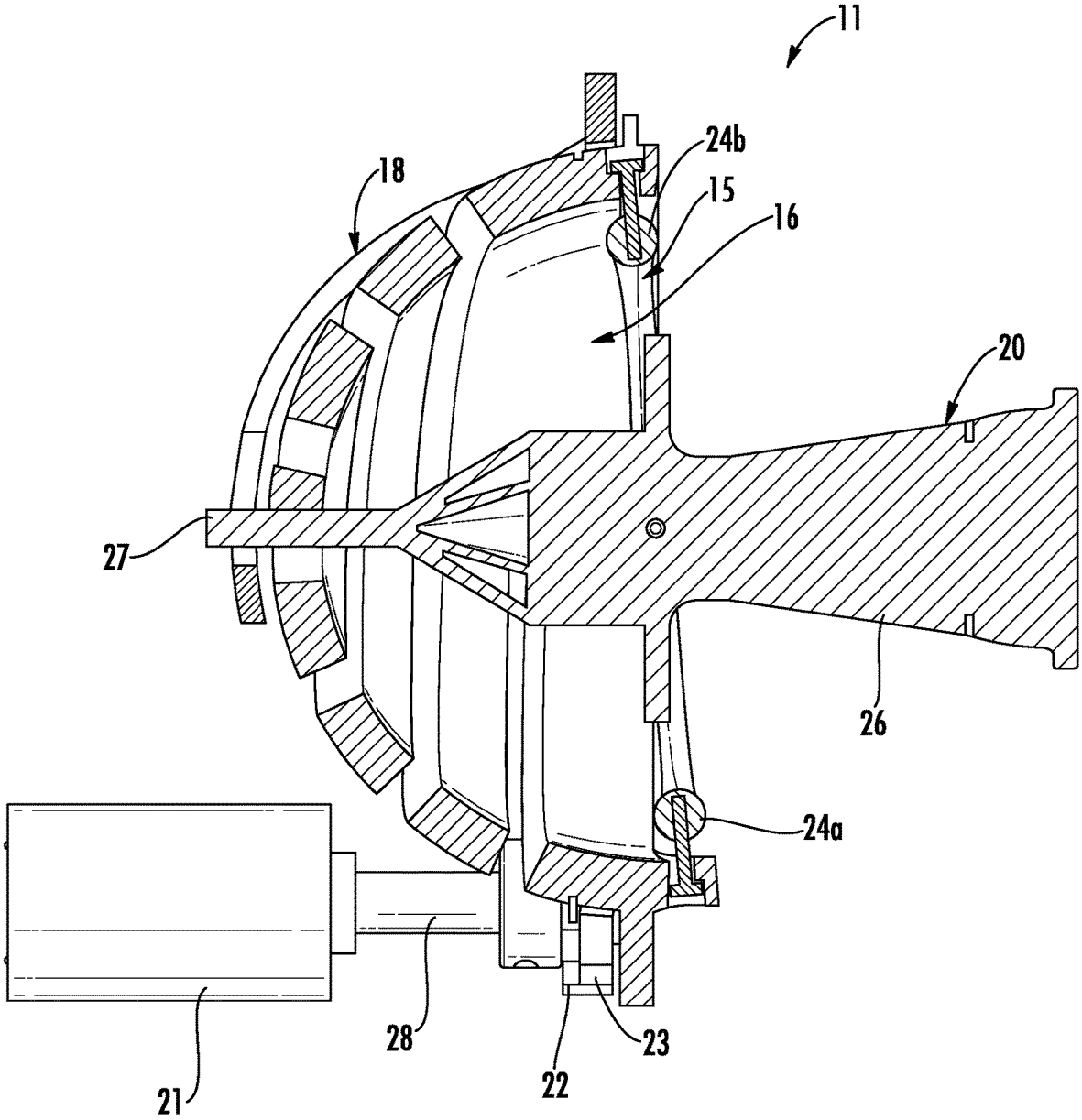
FIG. 5 is a schematic cross-sectional view of the antenna from the communication system of FIG. 1, along line 4-4.

The present disclosure will now be described more fully hereinafter with reference to the accompanying drawings, in which several embodiments of the present disclosure are shown. This present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art. Like numbers refer to like elements throughout, and prime notation is used to indicate similar elements in alternative embodiments.

Referring to FIGS. 1-5, a communication system 10 according to the present disclosure is now described. The communication system 10 illustratively includes a satellite-to-satellite communication system, for example. Of course, the communication system 10 may be used in other applications, such as ground-to-satellite applications, and ground-to-ground applications.

The illustratively includes an antenna 11, a radio frequency (RF) 12 transceiver coupled to the antenna, and a controller 13 coupled to the RF transceiver and configured to generate an RF signal to be transmitted and process a received RF signal. The antenna 11 illustratively includes a base 14, a gimbal mount 15 coupled to the base, and a first guide body 16 coupled to the base and having a first guide slot 17 therein. As perhaps best seen in FIG. 4, the antenna 11 illustratively includes a second guide body 18 rotatably coupled with respect to the base 14 and having a second guide slot 19 therein defining a steerable intersection position 30 (FIG. 4) with respect to the first guide slot 17.

In some embodiments, the base 14 and the first guide body 16 may be integrally formed as a single-piece. In other embodiments, the base 14 and the first guide body 16 may be modular and separate pieces.

The antenna 11 illustratively includes an antenna member 20 coupled to the gimbal mount 15 and extending through the steerable intersection position, and an actuator 21 coupled to the controller 13 and configured to selectively rotate the second guide body 18 to steer the antenna member. As will be appreciated, the operational frequency of the antenna 11 varies based upon the size of the antenna member 20, and the first and second guide bodies 16, 18.

The first and second guide bodies 16, 18 may comprise a dielectric material, for example, a polymer plastic. For manufacturing, the first and second guide bodies 16, 18, these components may be 3D printed. In some embodiments, the first and second guide bodies 16, 18 may comprise a metallic material. In these embodiments, the first and second guide bodies 16, 18 may be fabricated conventionally, such as via casting or machining, or via additive manufacturing approaches, such as metal 3D printing device methods.

In the illustrated embodiment, the first guide body 16 may have a dome shape, or a hemisphere shape. The first guide slot 17 illustratively includes a spiral shape. In other embodiments (FIGS. 6-7), the first guide slot 17 may have an elongate C-shape, which would cover a set scan volume. The second guide body 18 also illustratively has an elongate curved shape. The second guide slot 19 illustratively has an elongate shape.

In the illustrated embodiment, the antenna 11 further comprises drive shaft 28 driven by the actuator 21, and a drive gear 22 coupled between the second guide body 18 and the actuator 21 via the drive shaft. The second guide body 18 illustratively includes a geared periphery 23 to be driven by the drive gear 22, and an elongate wiper member 29 extending between opposing sides of the geared periphery.

The gimbal mount 15 illustratively includes first and second pivoting connections 24*a*-24*b* for coupling the gimbal mount to the first guide body 16. The gimbal mount 15 illustratively includes third and fourth pivoting connections 25*a*-25*b* for coupling the gimbal mount to the antenna member 20. As will be appreciated, the gimbal mount 15 provides free movement along two axes.

For example, the antenna member 20 illustratively includes a horn antenna, and may comprise a beam width of 10-30 degrees. Helpfully, since the horn antenna has a highly directional performance characteristic (i.e. high gain with low beam width), the antenna 11 may point the antenna member 20 at any direction needed to receive a desired RF signal. Of course, the horn antenna is simply an example antenna type, and other antenna types can be used. The antenna member 20 could also comprise a parabolic reflector, a slotted waveguide array, a flat panel phased array, or any other type of antenna element, as will be appreciated by those skilled in the art.

Also, to ensure full coverage, the spacing within the spiral path of the first guide slot 17 may need to be reduced when the antenna member 20 has a reduced beam width. Of course, the spacing within the spiral path of the first guide slot 17 can be increased when the antenna member 20 has an increased beam width, which allows for faster pointing of the antenna member.

The antenna member 20 illustratively includes a waveguide 26, and a guide rod 27 opposite of the waveguide and to be inserted through the steerable intersection position. It should be appreciated that the guide rod 27 may comprise a rigid RF cable feed for the antenna member 20. In other embodiments, the guide rod 27 may partially define the waveguide 26, thereby emitting a signal in a longitudinal opposite direction. In some embodiments, the actuator 21 comprises an electrical motor/single actuator configured to selectively cause to the antenna member to move in a spiral tracking path. That is, as the second guide body 18 rotates, the second guide slot 19 causes the guide rod 27 to move through the first guide slot 17, which causes the waveguide to point in the opposite direction with spiraling movement. Because of the spiral tracking path, the antenna 11 may not be appropriate for following moving RF sources.

The controller 13 is configured to aim the antenna member 20 based upon an encoding related to the actuator 21. In some embodiments, the actuator 21 comprises a stepper motor, and the controller is configured to equate a plurality of guide rod 27 positions within the spiral path of the first guide slot 17 with a corresponding plurality of steps from the stepper motor.

Figure 6:
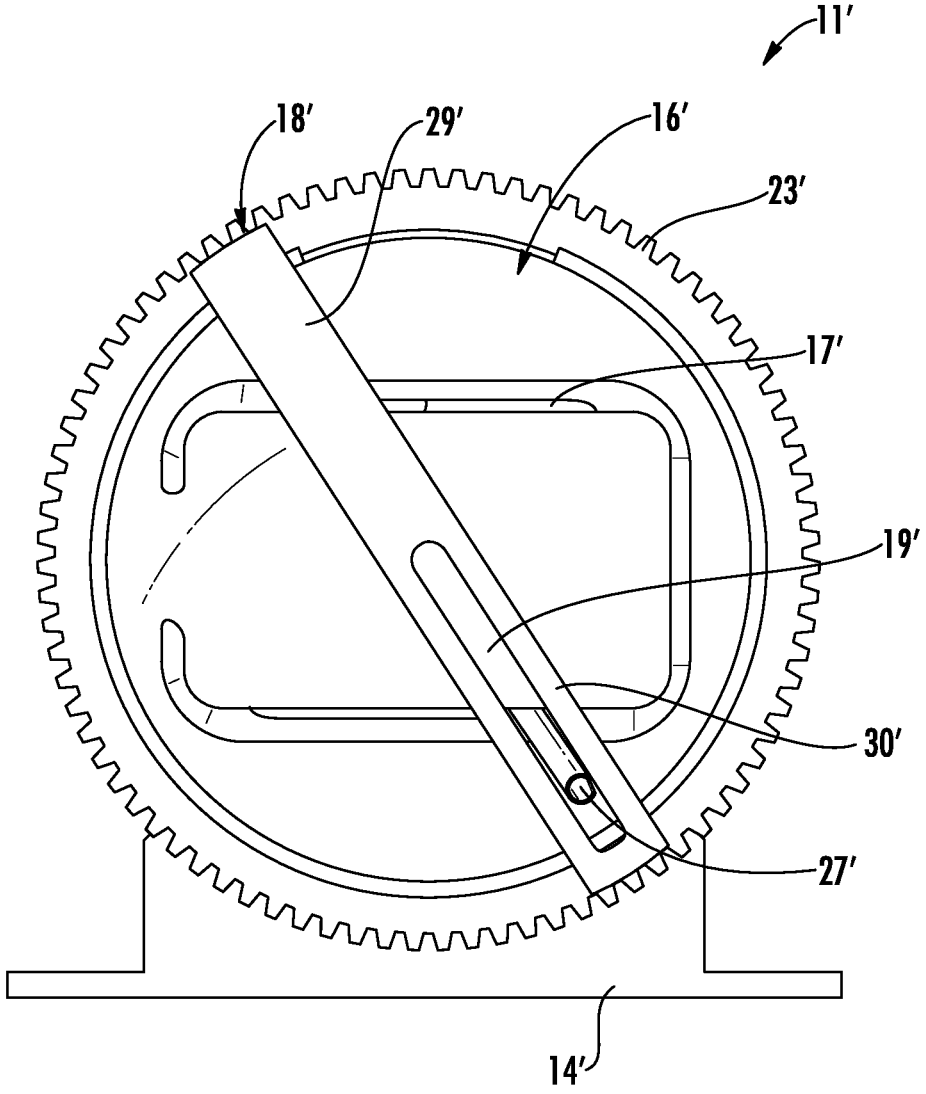
FIG. 6 is a schematic rear elevational view of another embodiment of the antenna from the communication system of FIG. 1.
Figure 7:
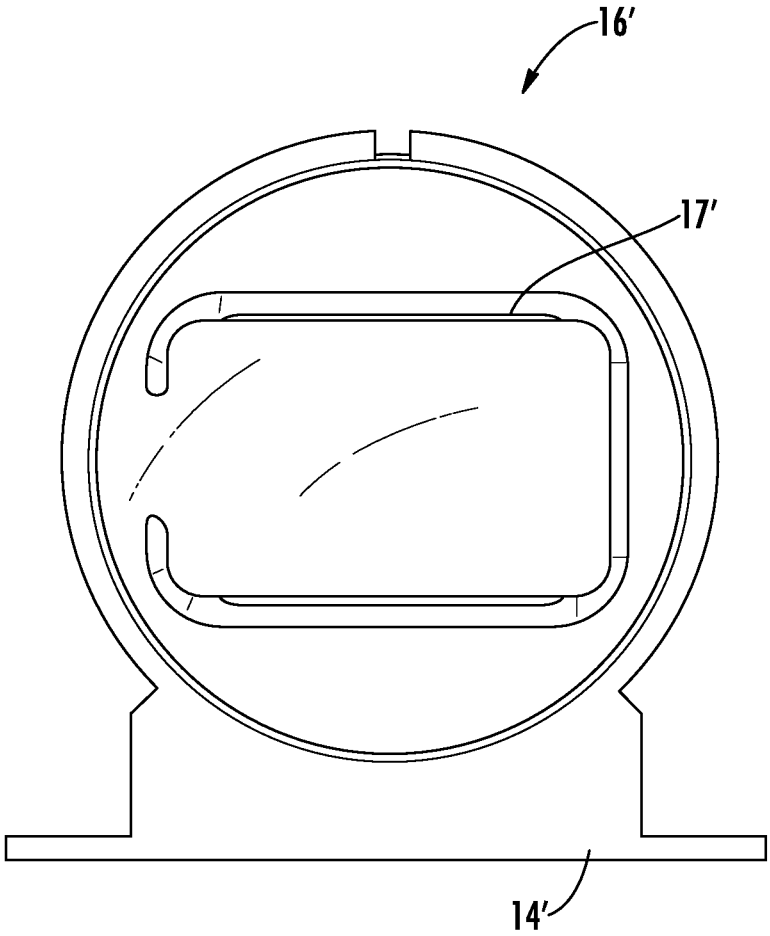
FIG. 7 is a schematic rear elevational view of the first guide body from the antenna of FIG. 6.

Another aspect is directed to a method for making an antenna 11. The method includes coupling a gimbal mount 15 to a base 14, coupling a first guide body 16 to the base, the first guide body having a first guide slot 17 therein, and rotatably coupling a second guide body 18 with respect to the base. The second guide body includes a second guide slot 19 therein defining a steerable intersection position 30 with respect to the first guide slot 17. The method comprises coupling an antenna member 20 to the gimbal mount 15 and extending through the steerable intersection position 30, and coupling an actuator 21 to selectively rotate the second guide body 18 to steer the antenna member. Referring now additionally to FIGS. 6-7, another embodiment of the antenna 11' is now described. In this embodiment of the antenna 11', those elements already discussed above with respect to FIGS. 1-5 are given prime notation and most require no further discussion herein. This embodiment differs from the previous embodiment in that this antenna 11' has a first guide body 16' has a first guide slot 17' that is C-shaped. This embodiment of the antenna 11' has a set scan volume that is dependent on the beam width of the antenna member 20 (FIGS. 1-5) and the spacing between the arms of the first guide slot 17'.

Advantageously, the antenna 11 may directionally aim the antenna member 20 across a full azimuth and elevation range using a single motorized actuator, rather than the multi-motor approaches of prior approaches. This reduction to a single motor is helpful in orbiting satellite platforms where space and weight are limited. In fact, the antenna 11 can be used to mechanically point antennas at a lower cost and a lower complexity than prior approaches. Moreover, redundancy measures are more easily implemented in the antenna 11 by adding additional actuators to drive the geared periphery 23 of the second guide body 18.

The smaller packaging volume allows this antenna 11 to be used in places where existing approaches are cost and/or size prohibitive (e.g. small-satellites). Also, this antenna 11 is advantageous for new space small satellites constellations (i.e. enabling crosslinks between orbiting satellites). The antenna 11 may enable robust and less costly satellite-to-satellite communication, and can be packaged within small satellite volume constraints, provide high data rate link solution versus broad beam low-directivity antennas, and provide potential use for ground applications for extremely low-cost antenna pointing mechanism for satellite terminals, such as satellite home paid television end user dish pointing.

Many modifications and other embodiments of the present disclosure will come to the mind of one skilled in the art having the benefit of the teachings presented in the foregoing descriptions and the associated drawings. Therefore, it is understood that the present disclosure is not to be limited to the specific embodiments disclosed, and that modifications and embodiments are intended to be included within the scope of the appended claims.

That which is claimed is:

1. An antenna comprising:

a base;

a gimbal mount coupled to said base;

a first guide body coupled to said base and having a first guide slot therein, said first guide body defining an open cavity, said gimbal mount being movable within the cavity, said first guide slot having a C-shape;

a second guide body rotatably coupled with respect to said base and having a second guide slot therein defining a steerable intersection position with respect to the first guide slot;

an antenna member coupled to said gimbal mount and extending through the steerable intersection position; and an actuator configured to selectively rotate said second guide body to steer the antenna member.

2. The antenna of claim 1 wherein said first guide body has a dome shape.

3. The antenna of claim 1 wherein said second guide body has an elongate curved shape.

4. The antenna of claim 1 wherein said second guide slot has an elongate shape.

5. The antenna of claim 1 further comprising a drive gear coupled between said second guide body and said actuator.

6. The antenna of claim 5 wherein said second guide body has a geared periphery to be driven by said drive gear.

7. The antenna of claim 1 wherein said antenna member comprises a horn antenna.

8. The antenna of claim 1 wherein said actuator comprises a single electrical motor.

9. The antenna of claim 1 wherein said first guide body is integral with said base.

10. An antenna comprising:

a base;

a gimbal mount coupled to said base;

a first guide body coupled to said base and having a first guide slot therein, said first guide body being dome shaped and defining an open cavity, said gimbal mount being movable within the cavity, said first guide slot being spiral shaped;

a second guide body rotatably coupled with respect to said base and having a second guide slot therein defining a steerable intersection position with respect to the first guide slot, said second guide body being elongate curved shaped;

an antenna member coupled to said gimbal mount and extending through the steerable intersection position; and an actuator configured to selectively rotate said second guide body to steer the antenna member.

11. The antenna of claim 10 wherein said second guide slot has an elongate shape.

12. The antenna of claim 10 further comprising a drive gear coupled between said second guide body and said actuator.

13. The antenna of claim 12 wherein said second guide body has a geared periphery to be driven by said drive gear.

14. The antenna of claim 10 wherein said antenna member comprises a horn antenna.

15. The antenna of claim 10 wherein said actuator comprises a single electrical motor.

16. A method for making an antenna, the method comprising:

coupling a gimbal mount to a base;

coupling a first guide body to the base, the first guide body having a first guide slot therein, the first guide body defining an open cavity, the gimbal mount being movable within the cavity, the first guide slot having one of a spiral shape and a C-shape;

rotatably coupling a second guide body with respect to the base, the second guide body having a second guide slot therein defining a steerable intersection position with respect to the first guide slot;

coupling an antenna member to the gimbal mount and extending through the steerable intersection position; and coupling an actuator to selectively rotate the second guide body to steer the antenna member.

17. The method of claim 16 wherein the first guide body has a dome shape.

18. The method of claim 16 wherein the second guide body has an elongate curved shape.

19. The method of claim 16 wherein the second guide slot has an elongate shape.

20. The method of claim 16 wherein the first guide body is integral with the base.

* * * * *